US006146207A

United States Patent [19]

Mulot

[11] Patent Number: 6,146,207

[45] Date of Patent: Nov. 14, 2000

[54] COUPLING ELEMENT FOR TWO PLUGS, ADAPTED MALE AND FEMALE ELEMENTS AND COUPLING DEVICE OBTAINED

[75] Inventor: Gerard Mulot, Nogent le Roi, France

[73] Assignee: Framatome Connectors International, Courbevoie, France

[21] Appl. No.: 09/274,076

[22] Filed: Mar. 22, 1999

[30] Foreign Application Priority Data

Mar. 23, 1998 [FR] France ..... 98 03776

[51] Int. Cl.[7] ..... H01R 25/00

[52] U.S. Cl. ..... 439/638; 439/344

[58] Field of Search ..... 439/638, 344, 439/676, 736, 639, 686, 689, 690, 695, 697, 708, 712

[56] References Cited

U.S. PATENT DOCUMENTS

| | | | |
|---|---|---|---|
| 3,954,320 | 5/1976 | Hardesty | 439/418 |
| 4,153,327 | 5/1979 | Johnson | 439/344 |
| 4,593,966 | 6/1986 | Meyer | 439/638 |
| 4,806,117 | 2/1989 | Johnston | 439/344 |
| 4,904,209 | 2/1990 | Nelson | 439/676 |
| 5,423,697 | 6/1995 | MacGregor | 439/638 |
| 5,429,522 | 7/1995 | Noschese et al. | 439/133 |

FOREIGN PATENT DOCUMENTS

| | | |
|---|---|---|
| 0028460A1 | 5/1981 | European Pat. Off. . |
| 0319138A1 | 6/1989 | European Pat. Off. . |
| 2723478 | 2/1996 | France . |

*Primary Examiner*—Khiem Nguyen
*Assistant Examiner*—Son Nguyen
*Attorney, Agent, or Firm*—Perman & Green, LLP

[57] ABSTRACT

The subject of the invention is a coupling element for two plugs comprising a body (18) provided with: a first base impression (24) arranged in said body, a terminal housing (34) able to receive an insert (32) in which is created a second base impression (30), a third connection impression (36) derived from the first impression and emerging in this terminal housing, and a contact-bearing connection block (32). The invention also covers the necessary male and female elements as well as the coupling device obtained.

14 Claims, 5 Drawing Sheets

Figure 1:
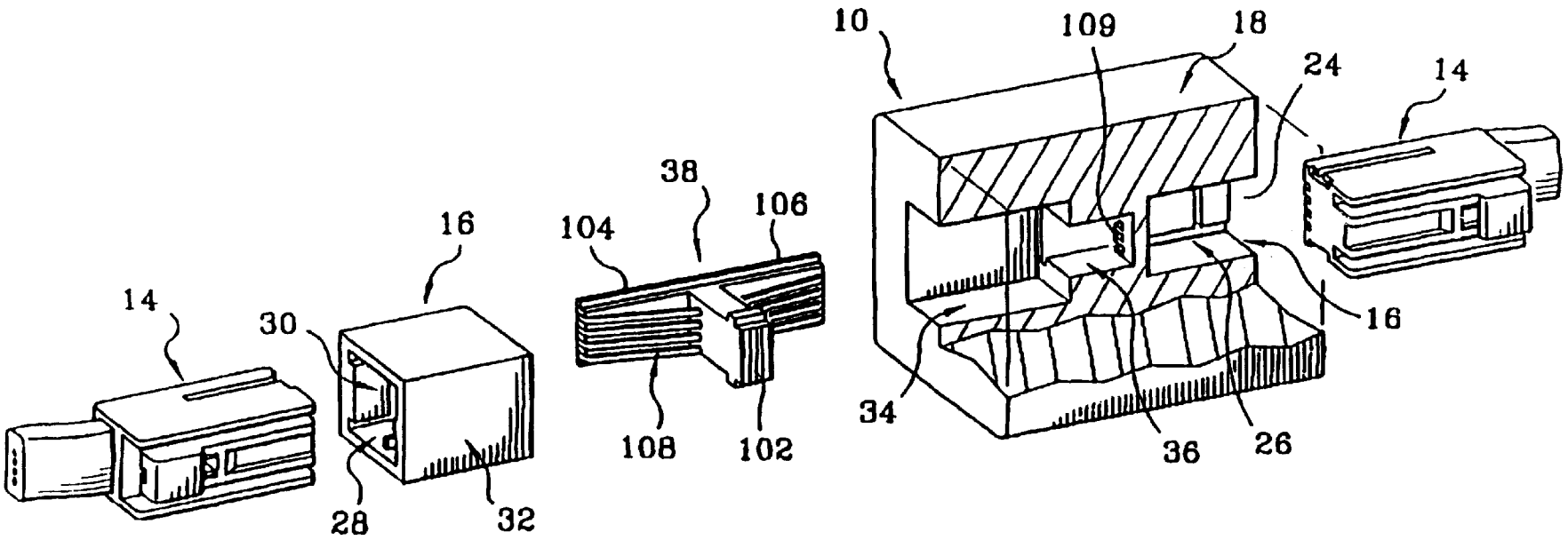

COUPLING ELEMENT FOR TWO PLUGS, ADAPTED MALE AND FEMALE ELEMENTS AND COUPLING DEVICE OBTAINED

The present invention concerns a coupling element for two plugs, the adapted male and female elements of said coupling element and the coupling device obtained. The present invention also concerns a particular mode of embodiment of this two-plug coupling element, of the crossing type.

Male and female connection means for flat electrical cords are known from the U.S. Pat. No. 3,954,320. These connection means are called "telephone jacks" or are sold commercially under the name "RJ 45".

These connection means have a block of electrically insulating material for the male element, which block has a housing provided to receive the end of the cord to be connected, i.e., more precisely, the sheet of wires which makes up said cord.

Means for locking the cord in translation relative to its housing prevent pulling the cord out of the block, for example, in the case of accidental pulling on the cord while the block is plugged in.

The electrical contacts comprise metal strips of small thickness, parallel to one another, of a number equal to the number of wires in the sheet. These strips are arranged in guide slots and can take two positions, the first a standby position, above the housing into which the sheet is introduced and the second is the set-in position, in which the strips are forced by translation, each into its respective slot. These slots guide the strips so that they come to cooperate electrically with the corresponding metal wire, through the insulating covering.

A female element is provided to receive the male element thus created. This female element comprises free ends projecting from wire conductors, designed to receive the strips with elastic support.

The serial manufacture of this type of socket has been facilitated while improving the quality of electrical contacts obtained during mounting and simplifying use in the field by operators.

Improvements have been brought to this type of element, particularly to resolve the problems of cross-talk; thus in French Patent No. 2,723,478, a base for an electrical connector that reduces cross-talk is claimed.

This base has an T shape with wire conductors that are placed according to several arrangements, but whose common characteristic is to provide a base in two blocks, each bearing a part of the conductors, these two blocks being joined together in a detachable manner in order to establish an electrical connection between the two parts of the conductors.

There are male and female elements provided to be encased in one another, but it is interesting to provide female/female double electrical coupling elements, able to receive a male element on either side.

Moreover, the very considerable development in cable networks more and more often poses the problem of crossing partitioned passages, which are, for example, walls in vehicles, industrial machines or even locations for professional usage, notably data sites. This is why the present invention also proposes a mode of embodiment of the crossing type.

RJ 45 elements such as described also have several disadvantages and the present invention proposes in addition to the double electrical coupling element and the mode of embodiment of the crossing type, male and female elements that are particularly adapted to said coupling element and which lead to a completely satisfactory coupling device.

The double electrical coupling element, the crossing-type variant, which crosses the particular elements proposed, and the device obtained particularly well conform to the needs of cable networks used for the operation of smart peripherals, notably in vehicles.

For this purpose, according to the invention, the double electrical female/female coupling element comprises a body provided with:

- a first base impression created in said body
- a terminal housing able to receive an insert in which a second impression is arranged,
- a third connection impression derived from the first impression and emerging into this terminal housing, and
- a contact-bearing connection block.

According to a particular mode of embodiment, the contact-bearing connection block is designed to be introduced through the terminal housing and comprises two opposed connection branches provided to project into each of the first and second impressions after mounting of the insert.

This contact-bearing connection block also comprises means for guiding and positioning the profile conjugated to that of the third impression.

According to particular modes of embodiment, the connection block has a general T or Z shaped profile.

The contacts of the connection block are strip contacts.

In order to render the element applicable to crossing walls, means for attachment of the body onto said wall are added to it.

The invention also concerns an electrical coupling device comprising such a female/female double coupling element as well as two plugs, each having a profile complementary to that of the first and second base impressions, these plugs and base impressions having complementary means for latching together comprising an elastic locking catch borne by each of the plugs, provided to cooperate with a stop manufactured with each of the impressions, guiding and polarizing means for the plugs as well as protection wings for the elastic catch borne by the plugs.

The present invention will now be described in regard to the attached drawings which represent a particular non-limiting mode of embodiment, drawings in which the different figures show:

FIG. 1, an exploded perspective view of a first mode of embodiment of a female/female double electrical coupling element according to the present invention.

Figure 2:
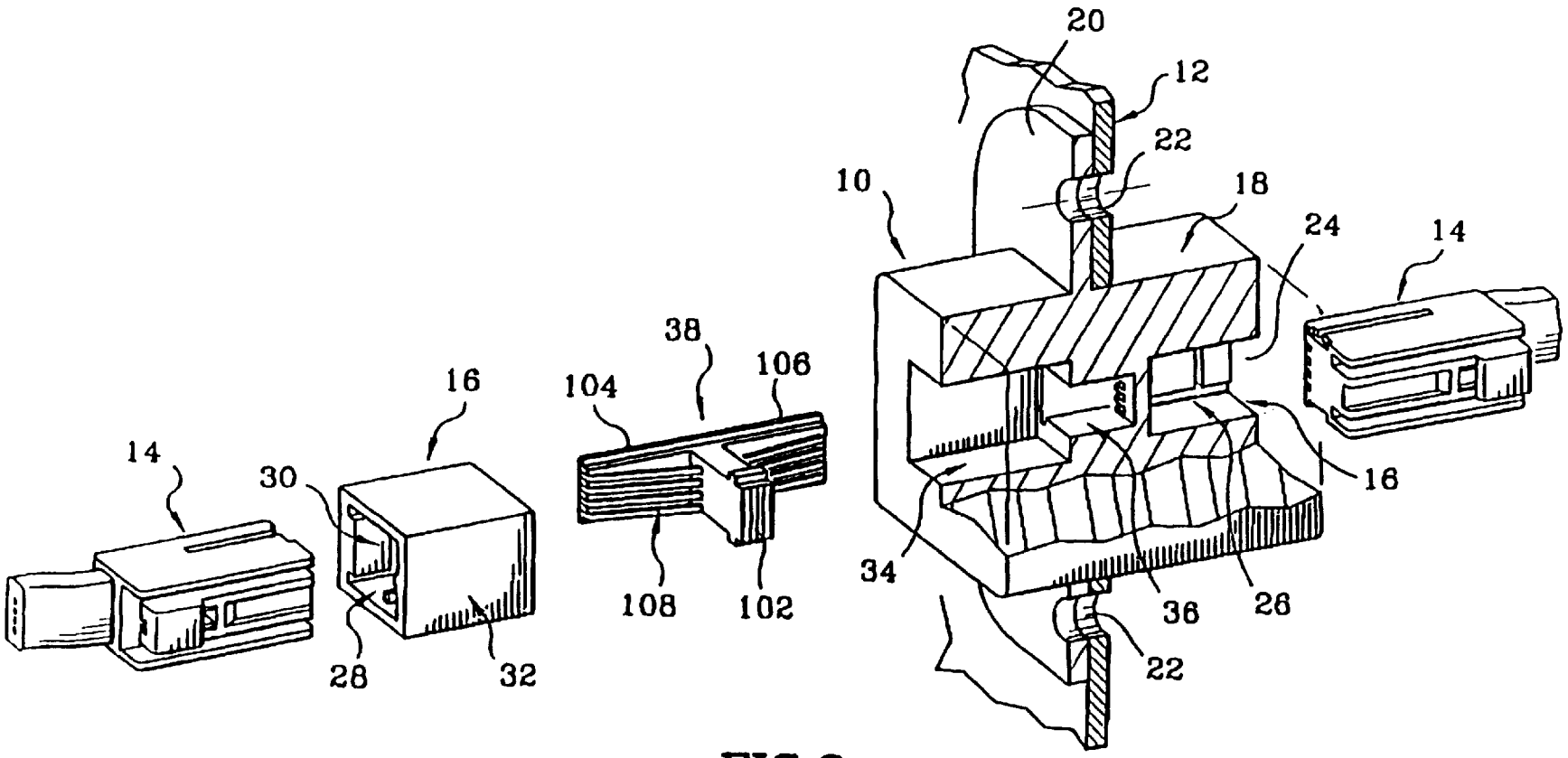

FIG. 2, an exploded perspective view of a first mode of embodiment of a crossing coupling element corresponding to the first mode of embodiment of a double coupling element.

Figure 3:
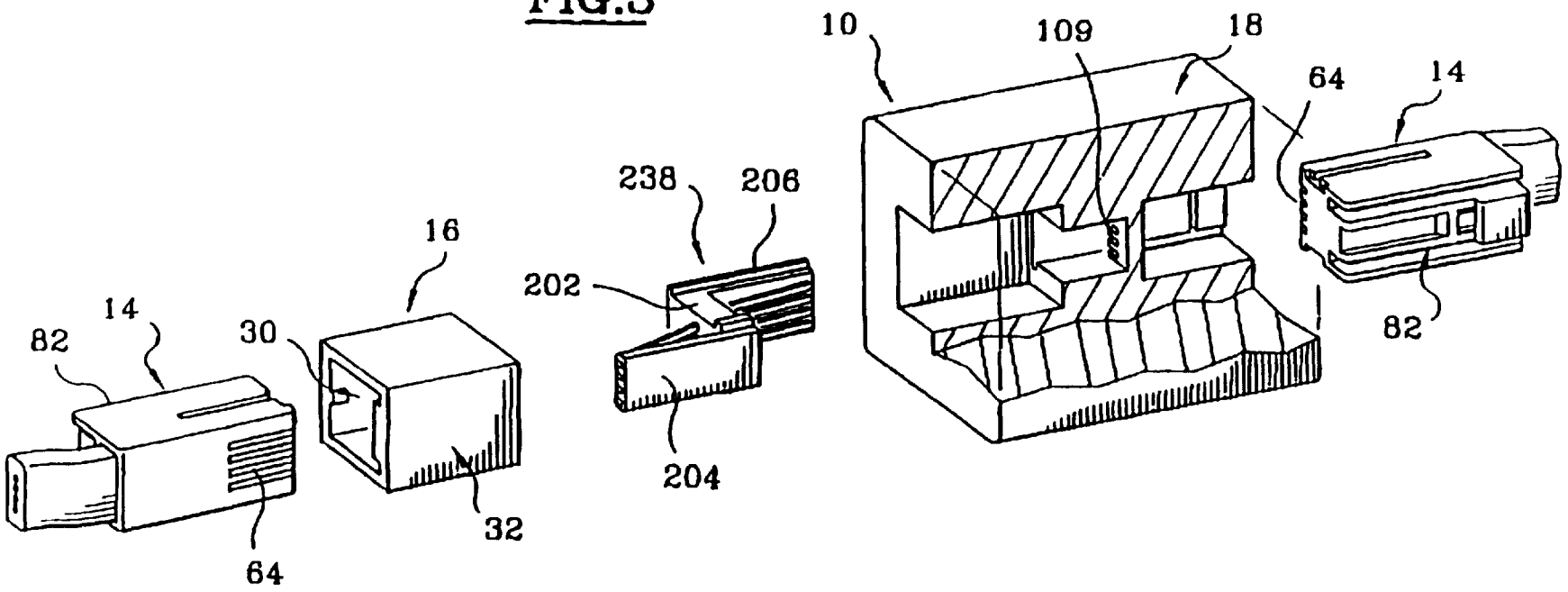

FIG. 3, an exploded perspective view of a second mode of embodiment of a double electrical coupling element according to the present invention.

Figure 4:
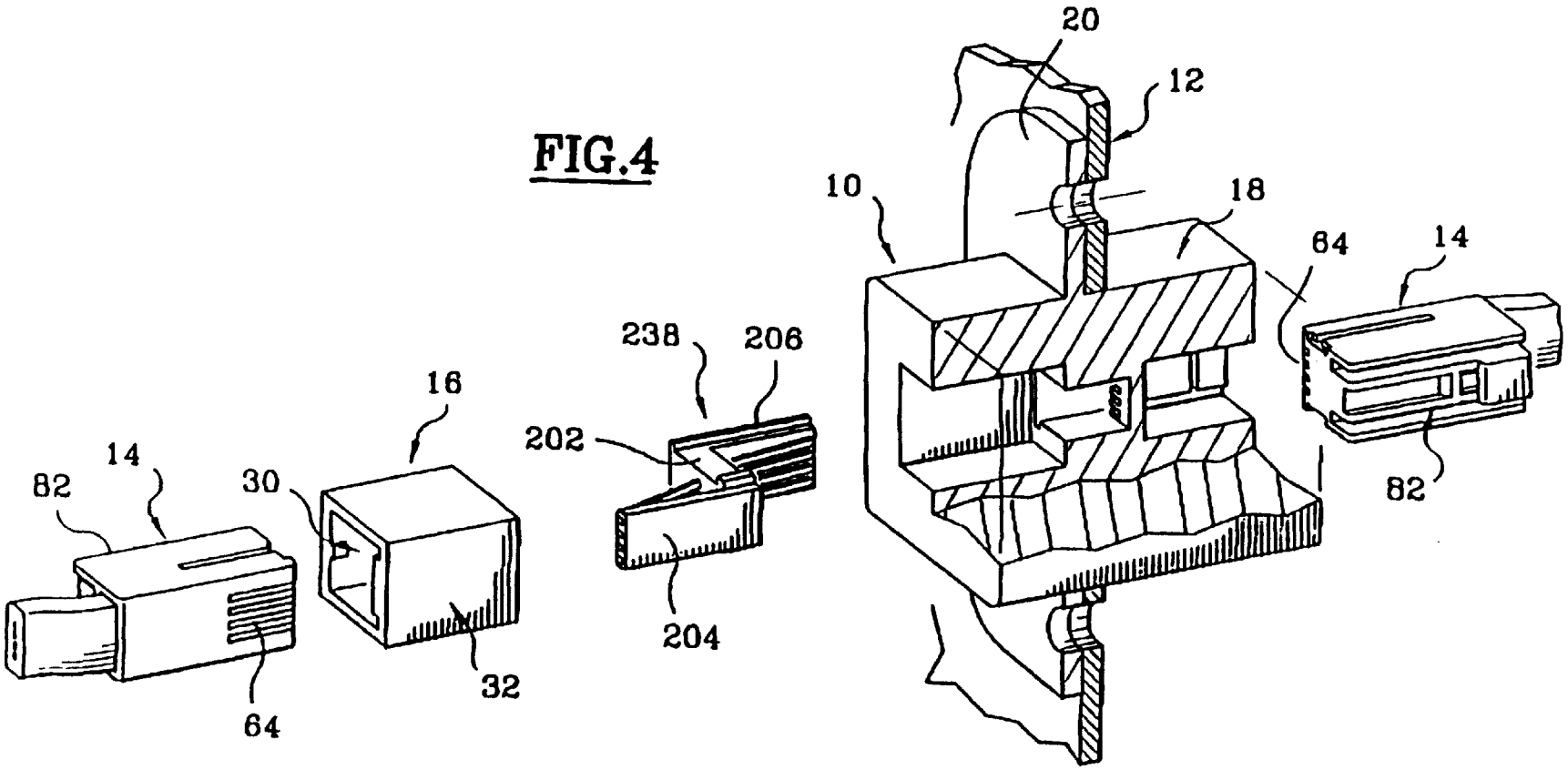
Figure 5:
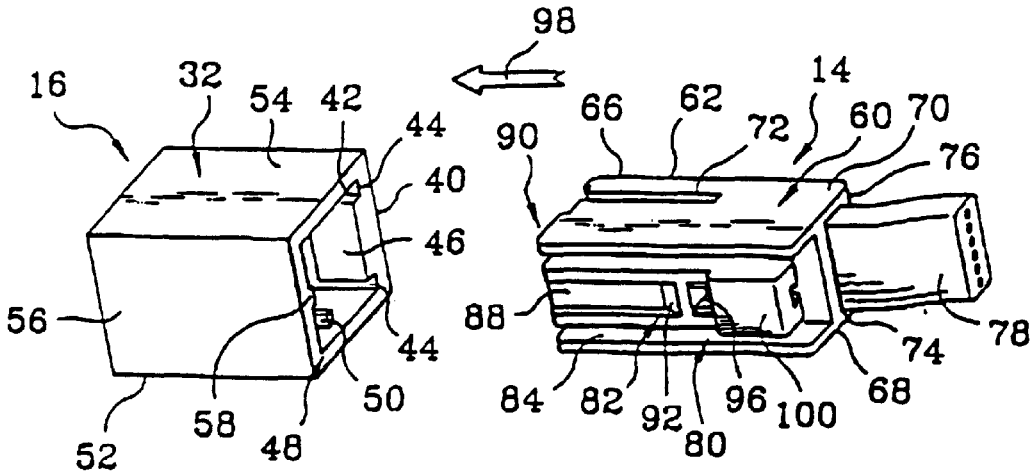

FIG. 4, an exploded perspective view of a second mode of embodiment of the crossing coupling element corresponding to the second mode of embodiment of the double coupling element, FIG. 5, a detail view of the male and female elements of FIGS. 1 to 4, before fitting together.

Figure 6:
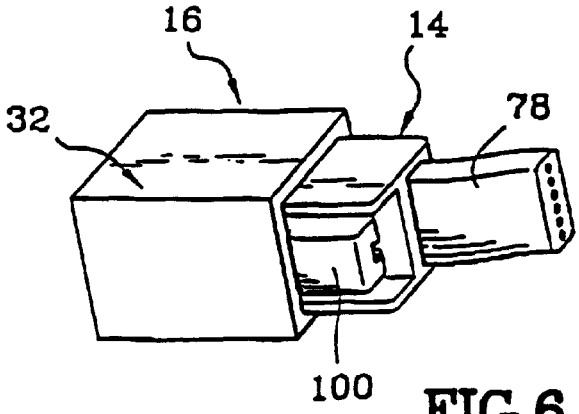
Figure 7:
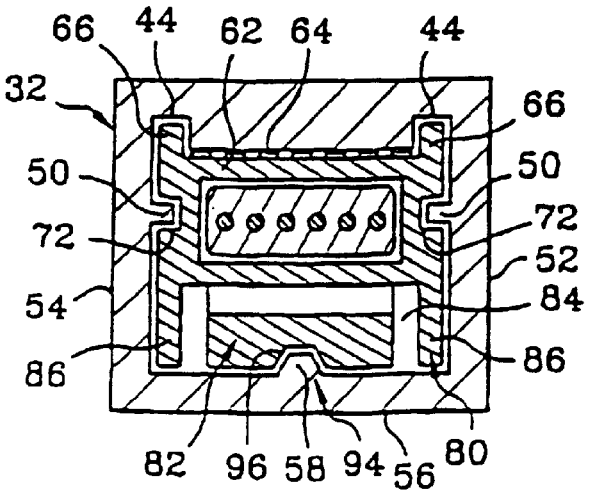

FIG. 6, a view of the male and female elements of FIG. 5 after fitting together, and FIG. 7, a sectional view of the male and female elements after fitting together.

In FIG. 1, we have shown a coupling element 10 and male elements 14 and female elements 16 designed for this coupling element.

This coupling element 10 comprises a body 18 having:

a first base impression 24 having an inner profile that constitutes a part of the first female element 26, a second base impression 28 having an inner profile that constitutes a part of the second female element 30, this impression being arranged in a removable insert 32, itself provided to be received in a terminal housing 34 formed in body 18 of said coupling element, and a third connection impression 36 provided to receive by insertion a contact-bearing electrical connection block 38 linking the two impressions.

For the description of the male and female elements or plugs, one can refer to FIGS. 5, 6 and 7 which show the detail of the mode of embodiment used.

The first impression 24 and the second impression 28 have a lower surface 40, which has a guiding means part designated in a general way by reference 42. This guiding means part comprises two longitudinal grooves 44 and an introduction and protection stud 46, to the right of front face 48.

Another part of the guiding means has two lateral longitudinal tabs 50 respectively borne by lateral faces 52 and 54.

Upper face 56 also bears another part of guiding means 42 in the form of a protrusion 58, arranged roughly to the right of front face 48.

Male element 14 comprises a block 60, roughly parallelepipedic, provided on its lower face 62 with strip contacts 64, visible in the section of FIG. 7.

This block 60 also bears, on a part of its length, two longitudinal tabs 66, provided to cooperate with grooves 44 created in lower face 40 of the female element. These tabs make up part of guiding means 42.

A groove 72 is created in each of the lateral faces 68 and 70 of this block 60, over a part of the length, so that these grooves cooperate with projecting tabs 50 borne by lateral faces 52 and 54 of the female element. These two grooves also make up an integral part of guiding means 42.

In this block, a housing 74 is provided, emerging onto rear face 76 to receive in a crimped manner, for example, an electrical connection cable 78.

An elastic catch 82 is provided on upper face 80 of this block 60, preferably molded with the block that bears it.

This catch 82 is arranged in a longitudinal recess 84 created in block 60, for which longitudinal wings 86 assure, on the one hand, the protection of the catch when male element 14 is stored or handled before being fit together, and also constitute, on the other hand, a part of guiding means 42. In fact, the catch bears a longitudinal groove 88, which is provided to receive in a sliding manner protrusion 58, which was molded with upper face 56, to the right of front face 48 of the female element.

This groove 88 has an open end to the right of surface 90 in front of the male element and an end closed by a bevel 92.

Locking means 94 are also provided, which are made up of a housing 96, in this case of truncated pyramid form, created on catch 82, so that it cooperates with protrusion 58. This housing is situated immediately behind groove 88 if one refers to the direction of introduction symbolized by arrow 98.

The catch is completed by a stop 100 positioned at its end and made to remain accessible from the outside when the male element is completely encased in the female element as shown in FIG. 6.

In the section of FIG. 7, one can better understand the arrangement of the different pieces after fitting together.

One notes that the guiding means are complete and assure a certain comfort to the user during the fitting together of the male element into the female element.

With regard to the difference between the first impression 24 and the second impression 28, in the first case, there is no insert 32, and the different parts of the guiding means notably are molded during manufacture of body 18 of coupling element 10.

In the first mode of embodiment shown in FIG. 1, electrical connection block 38 has a general T shape, foot 102 serving as guiding and positioning means.

Branches 104 and 106 bear electrical contact strips 108 provided to cooperate with contact strips 64 borne by male elements 14. A comb 109 assures a precise positioning of the contacts, even in the case of improper introduction or slightly deformed contacts.

The positioning of the coupling element according to the invention is indicated below.

Body 18 of the coupling element is held and then electrical connection block 38 is introduced into body 18 of the coupling element through the largest opening provided for this purpose, i.e., through housing 34 until foot 102 of this connection block is found generally perfectly positioned in third impression 36, of conjugate profile, the contacts being guided by comb 109.

Since impression 36 is found in central position, foot 102 remains in central position relative to body 18 of the coupling element, while branches 104 and 106 emerge in respective impressions 24 and 28 and remain to the right of each of lower faces 40 of female elements 26 and 30.

It is therefore suitable to position insert 32 in housing 34, which permits on the one hand, immobilizing electrical connection block 38 in its housing and on the other hand, bringing insert 32 back into this electrical connection block.

The coupling element is then ready to receive male elements such as elements 14. These male elements are simply plugged into the female elements.

It is noted that guiding means 42 assure a perfect positioning and the contact strips assure a cleaning of the contact strips by friction for both the strips borne by the male elements and those borne by the female elements. The elasticity of the strips on both sides also contributes to the quality of contacts.

The locking means for the male elements in the female elements have a great mechanical strength, which eliminates the problems of coming apart due to vibrations and/or possible pulling exerted within reasonable limits.

A variant of embodiment of the principal mode of embodiment of FIG. 1 is shown in FIG. 2, which is of the crossing coupling element type.

For this purpose, we have shown a wall 12 through which mounting of the electrical coupling element is provided.

For this purpose, body 18 has an attachment plate 20, molded with the body, provided with two holes 22 to receive the attachment means in a known manner, not shown, such as screws.

A variant of the mode of embodiment of the coupling element shown in FIG. 1 and which has just been described is illustrated in FIG. 3.

This variant consists of modifying connection block 38 to give a new block 238 of roughly Z profile, intermediate branch 202 being perpendicular to the two lateral branches 204 and 206.

The arrangement of each of the male and female elements is substantially identical, but the new symmetry permits connecting the male elements in the female elements with the same orientation for both sides, i.e., for example, in FIG. 3, with catch 82 oriented to the left relative to the corresponding female elements.

In the preceding description, the mounting of the connection block and the insert is provided on site, but it is completely possible to provide for factory mounting, the coupling element being then equipped with the connection block inserted, with two female elements, one of which has an insert and two joined male elements. It is sufficient for the user to pull back the two male elements, and crimp them onto the cables concerned and fit the two male elements in the concerned female elements.

The second mode of embodiment of FIG. 3 is shown in FIG. 4, in the crossing type variant. The identical elements are kept here. Only wall 12 and attachment plate 20 with its holes 22 are added.

What is claimed is:

1. Coupling element for two plugs comprising:

a body (18) provided with:

a first base impression (24) created in said body;

a terminal housing (34) created in said body;

a third coupling impression (36), derived from the first impression and emerging into the terminal housing;

an insert (32) received in said body (18) and located in the terminal housing (34), the insert having a second base impression (30); and a contact-bearing connection block (38) connected to the body (18) and having a frame with a section (102) located in the third coupling impression, and electrical contacts (108) located on the frame, the section (102) being sandwiched between the body (18) and the insert (32).

2. Coupling element according to claim 1, further characterized in that contact-bearing connection block (32) has guiding and positioning means (102) of conjugate profile to that of third impression (36).

3. Coupling element according to claim 2, further characterized in that connection block (38) has a general T profile.

4. Coupling element according to claim 2, further characterized in that connection block (38) has a general Z profile.

5. Coupling element according to claim 1, further characterized in that the contacts (108) of the connection block are strip contacts.

6. Coupling element according to claim 1, this coupling element being provided to be mounted across a wall (12), further characterized in that the coupling element comprises means (22) for attachment of body (18) onto said wall, said element then crossing over.

7. Electrical coupling device comprising a female/female double coupling element according to claim 1, as well as two male plugs having a complementary profile to that of the first (24) and second (28) base impressions, characterized in that the plugs and base impressions (24,28) have complementary latching means comprising an elastic locking catch (82) borne by each of the plugs provided to cooperate with a protrusion (58) manufactured with each of the impressions, guiding and polarizing means (50, 72) for the plugs as well as protection wings (86) for the elastic catch borne by the plugs.

8. A coupling element as in claim 1 wherein the frame comprises a second section which extends into the terminal housing.

9. A coupling element as in claim 8 wherein the second section extends into the second base impression.

10. A coupling element as in claim 9 wherein the frame comprises a third section which extends into the first base impression.

11. An electrical connector coupling element for connecting two plugs, the coupling element comprising:

a body comprising a first receiving area, a second receiving area, and a third receiving area;

an insert connected to the body and located, at least partially, in the third receiving area, the insert comprising a fourth receiving area;

a contact-bearing block connected to the body, the block comprising a frame and contacts mounted to the frame; and wherein a first section of the frame is located in the fourth receiving area, a second section of the frame extends into the fourth receiving area, the contacts extend into the first and first receiving areas, and the first and fourth receiving areas are generally sized and shaped to matingly receive the plugs.

12. A coupling element as in claim 11 wherein the body comprises a one-piece member.

13. A coupling element as in claim 11 wherein the frame of the contact-bearing block comprises a general Z shape.

14. A coupling element as in claim 11 wherein the frame of the contact-bearing block comprises a general T shape.

* * * * *